United States Patent [19]

Clark

[11] Patent Number: 4,577,350

[45] Date of Patent: Mar. 25, 1986

[54] DEVICE TO AUTOMATICALLY LOWER A LIFTED TOILET SEAT

[76] Inventor: Emmett T. Clark, Rte. 1, Box 442, Pittsboro, N.C. 27312

[21] Appl. No.: 720,964

[22] Filed: Apr. 8, 1985

[51] Int. Cl.[4] ..... A47K 13/00

[52] U.S. Cl. ..... 4/251; 4/253; 4/661

[58] Field of Search ..... 4/248, 251, 661, 253; 16/66, 82, 84; D8/402

[56] References Cited

U.S. PATENT DOCUMENTS

| | | | |
|---|---|---|---|
| 765,643 | 7/1904 | Tregoning | 4/251 |
| 1,051,508 | 1/1913 | Miller | 4/248 |
| 1,602,079 | 10/1926 | Kraft | 16/84 |
| 2,200,687 | 5/1940 | Bercot | 4/251 |
| 2,477,378 | 7/1949 | Jurinak | 4/248 |
| 3,303,517 | 2/1967 | Wood | 4/251 |
| 4,053,961 | 10/1977 | Wilson et al. | 16/84 |
| 4,103,371 | 8/1978 | Wilson | 4/251 |
| 4,477,933 | 10/1984 | Leckie | 4/661 |
| 4,491,991 | 1/1985 | Herbruck | 4/661 |

FOREIGN PATENT DOCUMENTS

| | | | |
|---|---|---|---|
| 633938 | 8/1936 | Fed. Rep. of Germany | 16/84 |
| 3108862 | 9/1982 | Fed. Rep. of Germany | 16/84 |
| 637678 | 4/1962 | Italy | 16/84 |

*Primary Examiner*—Stephen Marcus
*Assistant Examiner*—L. J. Peters
*Attorney, Agent, or Firm*—Brisebois & Kruger

[57] ABSTRACT

This invention relates generally to a device for automatically returning a lifted toilet seat, or a lifted toilet seat and its cover, when so equipped, to its normal lowered or horizontal position on the toilet bowl. More particularly, the invention relates to an easily mountable device for automatically returning a lifted toilet seat, or seat and cover, to the lowered position, a predetermined interval of time after the seat or cover is lifted and released, and in which this interval of time can be adjusted.

7 Claims, 5 Drawing Figures

DEVICE TO AUTOMATICALLY LOWER A LIFTED TOILET SEAT

BACKGROUND OF THE INVENTION

When the conventional domestic toilet is used as urinal by a male, the cover is lifted, and the seat is usually lifted. It is not unusual for the male, particularly a bachelor or one who is recently married to forget to lower the seat. This presents the inconvenience that a female, for example, a recent bride, using the toilet may inadvertently sit down on the rim of the toilet bowl without noticing that the seat was lifted.

For either sex to use the toilet in a seated position, at least the cover is lifted.

Where the household has pets such as kittens or small puppies, these pets often seek drinking water from the toilet bowl if the cover or cover and seat are left open, and may fall into the bowl.

Devices and apparatus for automatically lowering toilet seats or covers are known in the prior art as disclosed in the following U.S. Pat. Nos.:

1,134,755—Marcuse
2,200,687—Bercot
3,404,411—Newkirk
4,103,371—Wilson
4,195,372—Farina While Marcuse and Farina disclose relatively simple arrangements for closing covers or lowering seats, the cover or seat drops as soon as it is released.

In the arrangement of Wilson, the seat begins to lower as soon as foot pressure on its actuator is released.

While Newkirk and Bercot relate to mechanisms for lowering the seat or cover a predetermined interval of time after it is lifted, these mechanisms are quite complex and difficult to install.

Since these prior art devices and apparatus either close the seat or cover immediately, or are not readily installable by the home owner or apartment dweller without, in some instances, assistance of a plumber, the inconveniences and the possible dangers of lifted toilet covers and seats continue to exist.

In conventional toilets, lifted toilet seats or covers normally remain in the lifted position by pivotal movement about a hinge to an over-center position in which the seat rests against the water tank or some other support. To return the cover and seat to the lowered position on the bowl, it is necessary to pivot the seat and cover over-center on the hinge toward the closed position.

SUMMARY OF THE INVENTION

In accordance with the invention, a device is provided for automatically returning the toilet cover or seat, or the toilet seat and its cover to a closed position, a predetermined interval of time, for example, 3 to 6 minutes, after the cover or cover and seat are lifted.

The device is installed between the water tank or other support which supports the cover or seat in a stable, generally upright, over-center position on its hinge, and the cover or seat itself. The device is so positioned with respect to the lifted cover or seat that the cover or seat is moved on its hinge toward the bowl beyond the over-center position, from which it can descend by gravity to the closed position.

In accordance with the invention, a device is provided which is quickly collapsable and slow to expand to its original shape, and is mounted between the cover or seat and the support which the cover or seat engages in its stable upright or lifted position. The device is collapsed between the cover or seat and the support to a dimension sufficiently small that the cover and/or the seat remain in the stable upright position when the cover or seat is manually lifted to the upright, opened position and released. The device includes a resilient or elastic portion which causes it to resume its original shape, after elapse of the time interval, and thus push the seat or cover over-center on the hinge, toward the bowl.

In a preferred embodiment, a resilient device is provided which contains air at ambient pressure, and which is so mounted that the device is collapsed and deflated between the cover or seat and the support, when the cover or seat is moved to the upright stable opened position. The device includes a check valve to permit air to rapidly escape, but which prevents rapid reinflation. Reinflation occurs as a result of a resilient portion of the device via an air bleed, which permits the device to reinflate and expand very slowly from its collapsed condition. The device can be an elastic bulb with a check valve and air bleed.

In accordance with a preferred form of the invention, the collapsable-expandable device can be placed in a decorative bag which is suspended from a cord clamped between the water tank and the water tank lid. In this arrangement, spacers can be placed in the bag on opposite sides of the deflatable element to vary its expanded thickness, thereby permitting the device to be used on toilets of various constructions in which the distance between the hinge line and the toilet tank is different.

In a preferred form of the invention, the inflatable device takes the form of a resilient bulb with a check valve to permit rapid escape of air, and an adjustable air bleed valve to provide controlled, timed reinflation to its original inflated form.

In accordance with one aspect of the invention, the device can be regarded to be a training or reminder device, because of the thud or thump which occurs when the seat or cover returns to the lowered position, which will indicate to the previous user that the cover or seat was left opened.

Other features and advantages of the invention will become apparent from the accompanying drawings.

DETAILED DESCRIPTION

Figures 1, 2, 3:
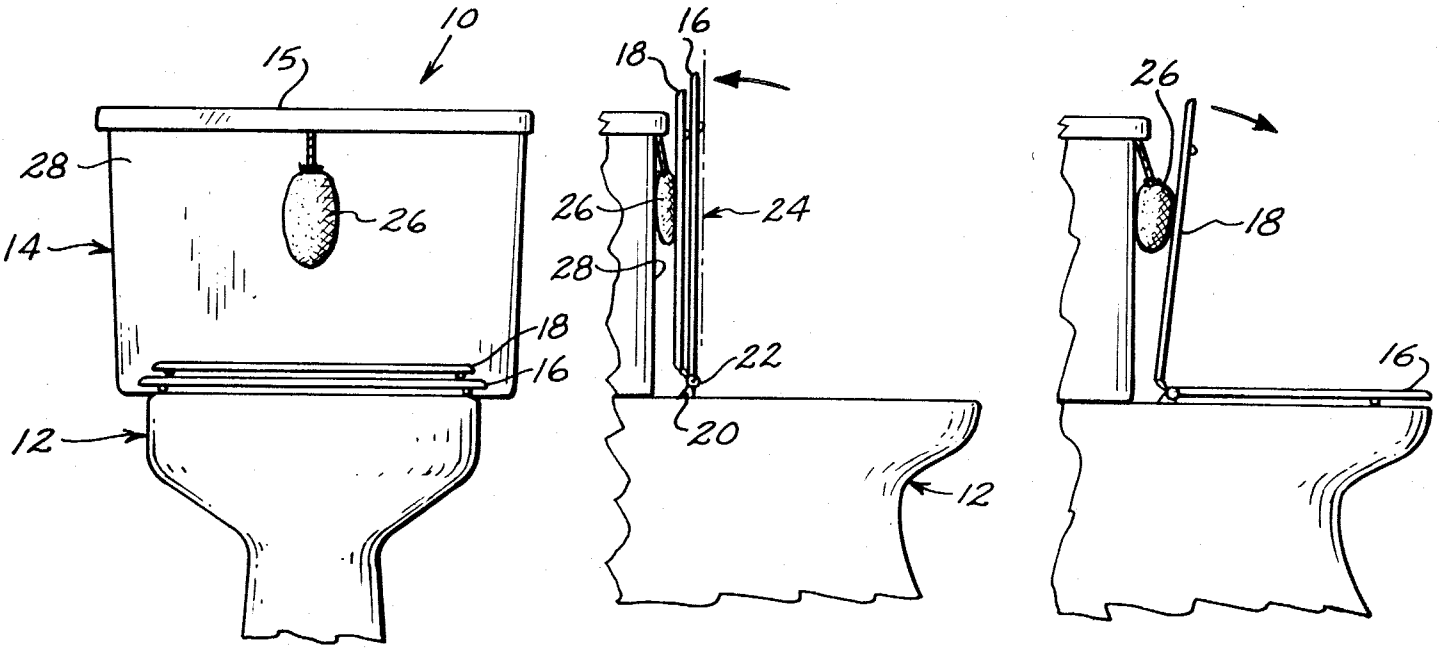
FIG. 1 is a front view of a toilet with the device of the invention mounted thereon.
FIG. 2 is a side view of the toilet of FIG. 1 showing the seat and cover lifted to an upright stable position, to collapse the device of the invention.
FIG. 3 is a side view of the toilet of FIG. 2 showing the seat lowered and the cover being lowered, by expansion of the device according to the invention.

Referring to FIG. 1, there is shown a conventional toilet 10, having a bowl 12 and a water tank 14.

As is evident from FIGS. 1–3, toilet 10 is equipped with a toilet seat 16 and a cover or lid 18 connected to the toilet bowl 12 by a hinge assembly 20 The hinge assembly includes an axis 22 about which both the hinge and seat can pivot from the lowered position shown at FIG. 1 to the upright or lifted position shown at FIG. 2.

In the position shown at FIG. 2, both the cover 18 and seat 16 are in a stable generally upright position in which the center of gravity of both the seat and the lid are to one side of, i.e. to the left of, a vertical plane including the hinge axis 22, which plane is indicated in FIG. 2 by phantom line 24.

FIG. 1 shows a collapsible and expandable device 26, according to the invention mounted on toilet 10 so that device 26 is between cover 18 and seat 16, and a surface such as front surface 28 of water tank 14.

The device 26 is of the type which is rapidly collapsible with the application of a relatively small force, but which expands very slowly to its original shape when the collapsing force is released.

As shown at FIGS. 1–3, when the cover 18 and seat 16 are lifted to the stable upright position shown at FIG. 2, device 26 is collapsed and the cover and seat remain in the position of FIG. 2 for a predetermined period of time. As the device 26 expands to its original shape or expanded state, the seat and cover are gradually pivoted about hinge axis 22 until the center of gravity of first the seat, and eventually the cover passes through the vertical plane 24 of hinge axis 22. The seat 16 first descends to the lowered position on the bowl as shown at FIG. 3, by gravity, and the cover 18 soon follows, as the device 26 continues to expand toward its original shape. In the position shown at FIG. 3, the cover 18 has already moved over-center toward its closed position and is beginning its descent to the lowered position of FIG. 1.

It is to be appreciated in accordance with the invention that the device 26 need only exert a force sufficient to pivot the cover or lid from the FIG. 2 position, slightly to the left of the vertical plane 24 of hinge axis 22 to a position in which the center of gravity of the seat and eventually the center of gravity of cover 18 is slightly to the right of this vertical plane so the seat and cover descend by gravity to the closed position of FIG. 1.

Figure 4:
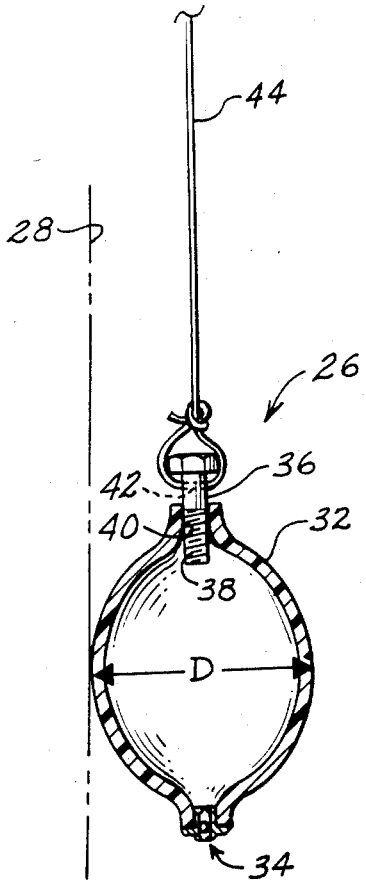
FIG. 4 is a view in vertical section of one embodiment of a collapsible-expandable device according to the invention.

FIG. 4 shows one embodiment of a collapsible-expandable device in accordance with this invention. As shown, there is an elastic bulb 32 having a check valve 34 at its lower end, and a cap screw 36 threaded into its upper end. Check valve 34 is of the type which permits air from within bulb 32 to be rapidly expelled when the bulb is squeezed or collapsed, but prevents return flow of air into the bulb. The cap screw 36 threaded into the upper end of the bulb functions as an air bleed to permit bulb 32 to very slowly inflate after it is collapsed. The threads 38 of the cap screw 36 provide a small helical air flow space between the roots of the thread and the interior of the opening 40 of bulb 32 into which cap screw 36 is threaded.

The cap screw 36 can be provided with a transverse opening 42 in its shank to receive a cord or wire 44, for suspending bulb 32 at an appropriate position on surface 28. There can be a hook at the upper end of cord 44 to suspend bulb 32 by placing the hook over the top rim of water tank 28. Alternatively, cord 44 can simply have a knot or enlarged portion at its upper end by which it can be clamped between the toilet tank cover 15 and the upper edge of the front of toilet tank 14.

As shown at FIG. 4, bulb 32 in its expanded condition has a diameter D which is greater than the distance from vertical support 28 to the over-center position of the seat or cover from which the seat or cover can descend by gravity to the closed position on the toilet bowl.

Figure 5:
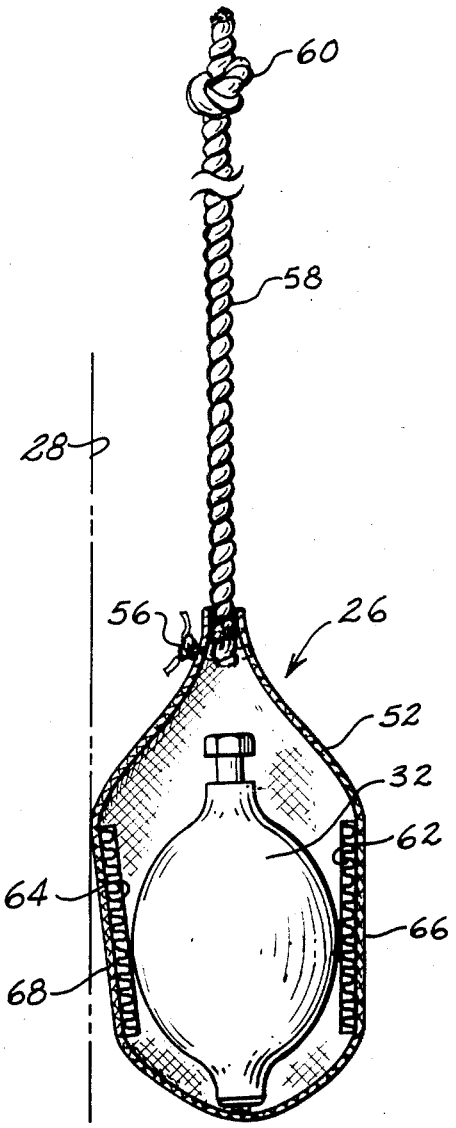
FIG. 5 is a view in partial vertical section of another embodiment of collapsible-expandable device according to the invention.

In the embodiment of bulb 32 shown at FIG. 4, the diameter D is approximately 2 inches, the bulb has a length between its ends of approximately 3 inches, and the opening 40 in the upper end of the bulb is of a diameter to permit a ¼-inch cap screw 36 to be threaded into this opening. FIG. 5 shows another arrangement of collapsible-expandable device according to the invention. The embodiment of FIG. 5 includes the bulb 32, which in this embodiment is placed in a flexible bag 52 equipped with a drawstring 56 which permits closing the upper end of the bag so that the rubber bulb 32 is not visible. Attached to the upper end of bag 52 is a cord 58, the upper end of which can include a knot 60 for suspending the bag with bulb 32 therein at an appropriate elevation adjacent surface 28.

Bag 52 is preferably of cloth or other flexible material which permits the passage of air, and can be of a decorative material such as a floral print, or of a matching color to the toilet seat 16 and cover 18, or can match the cloth covers sometimes applied onto the toilet seat cover 18.

In the embodiment of FIG. 5, if the diameter D of bulb 32 in its expanded state is not sufficient to move the seat 16 and cover 18 over-center, so the seat and cover can descend by gravity, spacers 62 and 64 can be inserted into bag 52 at opposite sides of the bulb 32. As shown at FIG. 5, the spacer 64 is generally flat and parallel with surface 28. Similarly, spacer 62 would be parallel to the toilet seat 16 and lid 18, in the upright position of FIG. 2. A suitable material for spacers 62 and 64 is corrugated paperboard of a thickness of about ⅛-inch, and which is cut to a width slightly less than the diameter D and has a height slightly less than the height of bulb 32 between its ends. Such spacers have been found to lie flat against the front and rear portions 66 and 68 of the bag and do not have a tendency to shift within the bag when bulb 32 collapses and expands.

Mounting the collapsible-expandable device 26 on the toilet is relatively simple. For the embodiment of FIG. 4, one holds cord 44 with bulb 32 between cover 18 and surface 28, while pushing cover 18 toward the stable upright position shown at FIG. 2. When the bulb 32 is collapsed, pressure on the seat and lid is released, and if the seat and lid remain in the stable upright position, it is known that the bulb 32 is properly positioned.

The air bleed provided by the threads of cap screw 36 provide the air bleed to permit bulb 32 to slowly expand to its original shape. The cap screw 36 is initially threaded into opening 40 a sufficient amount that 3–6 minutes elapse between the time that the toilet seat and cover are lifted and collapse bulb 32, and the time that the bulb 32 expands sufficiently to move the seat and cover to the over-center position shown at FIG. 3 so that the seat and cover descend by gravity. It is to be appreciated, however, that the extent of the air bleed can be adjusted by the user.

With regard to the embodiment of FIG. 5, it has been found that in most instances, the spacers 62 and 64 are not required and that simply inserting the bulb 32 into the bag provides a collapsible-expandable device which operates satisfactorily in accordance with the invention. If, however, the original diameter of bulb 32 is not sufficient, spacers 62 and/or 64 can be added to increase the thickness of the device in the expanded state of bulb 32.

While preferred embodiments have been described in which the device 26 is mounted on a toilet tank by a suspending cord or wire, either the bulb 32 alone or the arrangement of FIG. 5 in which bulb 32 is within a bag 52, can be mounted on the front surface of the toilet tank in any suitable manner, for example, by applying a strip of Velcro to bulb 32 in the case of the embodiment of FIG. 4 or to the outside of bag 52 in the case of the embodiment of FIG. 5, and attaching a mating strip of Velcro to the surface 28. Adhesively applying the Velcro to surface 28 or directly to the surface of bulb 32 has been found to be satisfactory.

While the invention has been described in terms of closing both the seat 16 and cover 18, it may in some instances be desirable to only lower seat 16 and not cover 18. For this purpose, the device 26 is so positioned that seat 16 is pushed to its over-center position, but cover 18 remains with its center of gravity to the left of hinge line 24, so that the cover remains in the upright position.

Of course, where the toilet is not equipped with a cover 18, device 26 will be mounted between seat 16 and surface 28. In some instances, it may also be desirable to simply mount the device between the underside of the cover and an upper surface of seat 16.

While the surface 28, in the example disclosed above is the front surface of a toilet tank, depending on the construction of the toilet, other surfaces which perform the same function can be used or provided.

While preferred embodiments have been disclosed, changes can be made without departing from the scope of this invention.

I claim:

1. Apparatus for moving a hinged toilet seat or toilet cover from an open generally upright position on one side of the vertical plane of its hinge, to a lowered position on the bowl on the other side of the vertical plane of the hinge, by forcing the seat or lid through an over-center position on the hinge to then pivot to the lowered position by gravity, said apparatus comprising, a hollow collapsible device containing air at ambient pressure, a check valve associated with the device for permitting rapid expelling of air from the device in response to compression and collapsing thereof, said hollow device including resilient means for expanding the device to its original shape, means for mounting said collapsible device at a location adjacent an upright surface such that the device is suffiently compressed and collapsed by the upper surface of the lid or seat upon movement thereof to the generally upright position so that the lid or seat remains in the upright position, an air bleed means associated with the collapsible device for permitting the device to reinflate slowly within a predetermined period of time after it is collapsed, said device being so mounted and of such an inflated size that the seat or lid is forced to said over-center position and descends as said device expands to its original shape.

2. Apparatus according to claim 1 wherein said collapsible device comprises an elastic bulb.

3. Apparatus according to claim 1 wherein said means mounting said device comprises a flexible suspension element connected to an upper portion of a water tank of the toilet.

4. Apparatus according to claim 2 wherein the apparatus further comprises a bag of flexible material for containing said elastic bulb, and said mounting means comprises means for suspending the bag with the elastic bulb therein between a front surface of a water tank of the toilet, and said cover or seat.

5. Apparatus according to claim 4 further comprising removable spacer means in said bag between a wall of the bag and the elastic bulb for adjusting the thickness of the apparatus to permit its use with toilets in which the spacing between the hinge line of the seat or cover is different.

6. Apparatus according to claim 1 wherein said air bleed means comprises manually adjustable air bleed means for adjusting the predetermined period of time required for the device to resume its original expanded shape.

7. Apparatus according to claim 2 wherein said air bleed means comprises manually adjustable air bleed means for adjusting the predetermined period of time required for the device to resume its original expanded shape.

* * * * *